US005582409A

United States Patent [19]

Mayorga et al.

[11] Patent Number: 5,582,409

[45] Date of Patent: Dec. 10, 1996

[54] BASEBALL BOARD GAME

[76] Inventors: Fernando Mayorga; Ruth Mayorga, both of 47-19 215th St., Bayside, N.Y. 11361

[21] Appl. No.: 443,586

[22] Filed: May 17, 1995

[51] Int. Cl.[6] ..... A63F 3/00

[52] U.S. Cl. ..... 273/244

[58] Field of Search ..... 273/242, 243, 273/244, 277, 93 R, 93 C

[56] References Cited

U.S. PATENT DOCUMENTS

| | | | |
|---|---|---|---|
| 298,192 | 5/1884 | Foote | 273/244 X |
| 356,870 | 2/1887 | Finley | 273/244 X |
| 1,170,821 | 2/1916 | Keller | 273/244 X |
| 2,886,319 | 5/1959 | Henderson | 273/244 X |
| 3,368,813 | 2/1968 | McGraw | 273/93 R |
| 4,000,897 | 1/1977 | York | 273/244 X |
| 4,210,335 | 7/1980 | Licciardi | 273/244 X |
| 4,452,453 | 6/1984 | Daley | 273/93 R |
| 5,108,110 | 4/1992 | Nerbas | 273/244 |
| 5,129,651 | 7/1992 | Tobias | 273/244 X |
| 5,415,412 | 5/1995 | McMahon | 273/244 |

FOREIGN PATENT DOCUMENTS

| | | | |
|---|---|---|---|
| 2455909 | 1/1981 | France | 273/244 |
| 2184028 | 6/1987 | United Kingdom | 273/244 |

*Primary Examiner*—William E. Stoll

[57] ABSTRACT

A baseball board game which essentially utilizes a plurality of ball squares, a plurality of colored cards, and red and blue dice to simulate a real baseball game by the frequency of plays and events which occur during an actual baseball game.

4 Claims, 5 Drawing Sheets

FIG 1
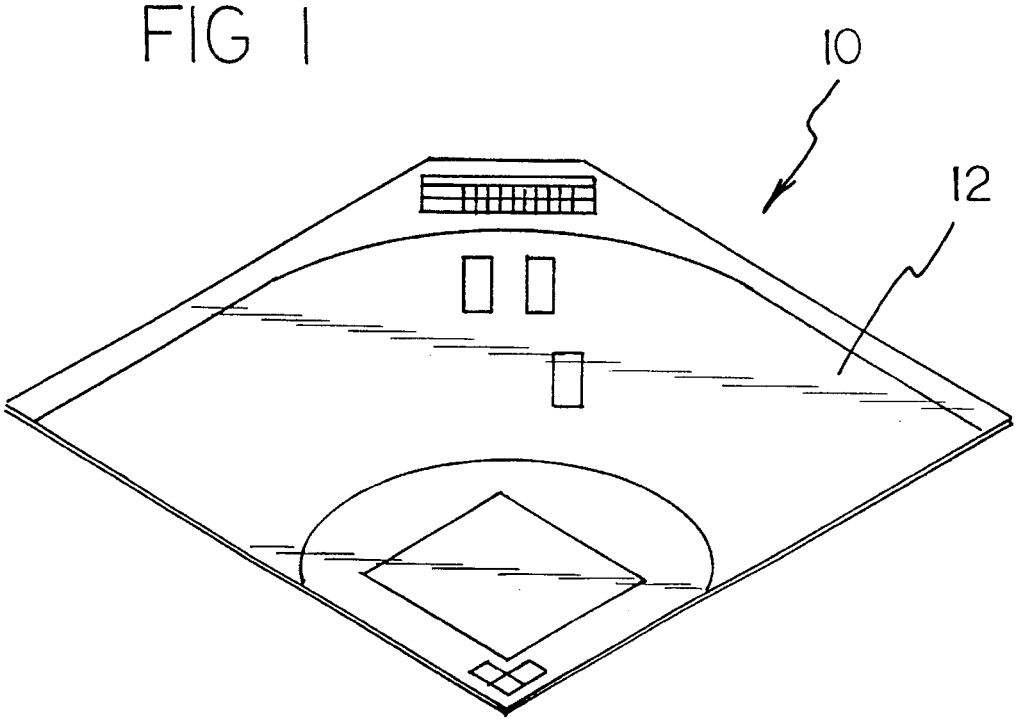
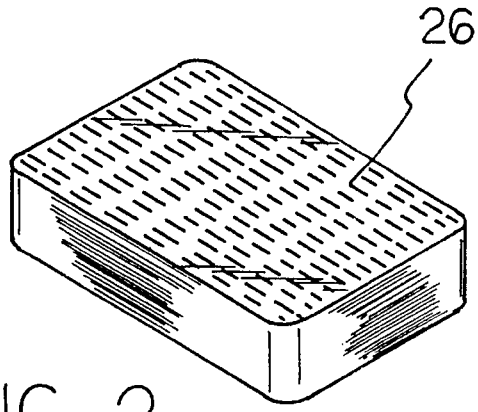
FIG 2
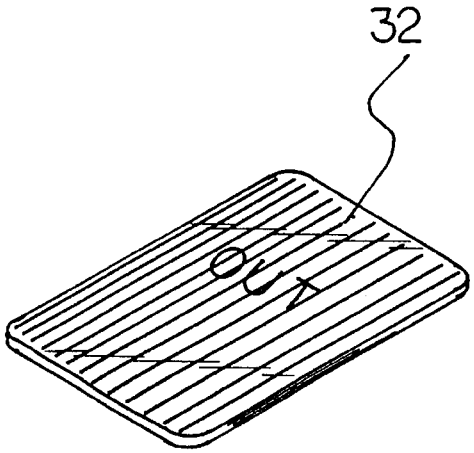
FIG 3

FIG 8
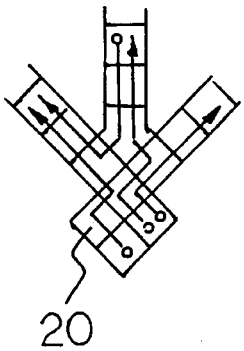
FIG 9
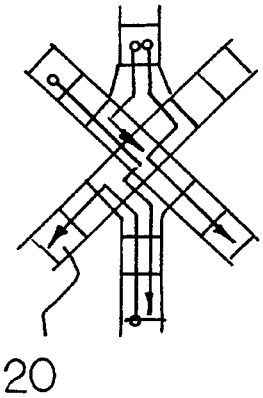
FIG 10
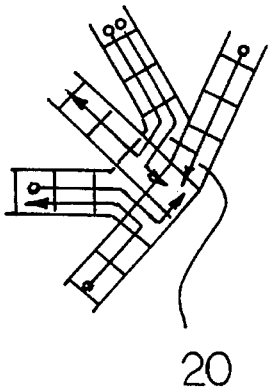
FIG 11
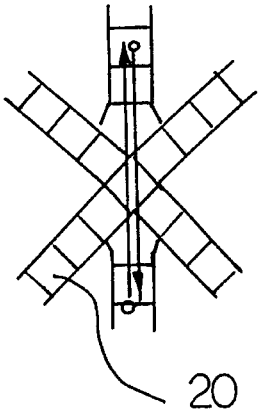
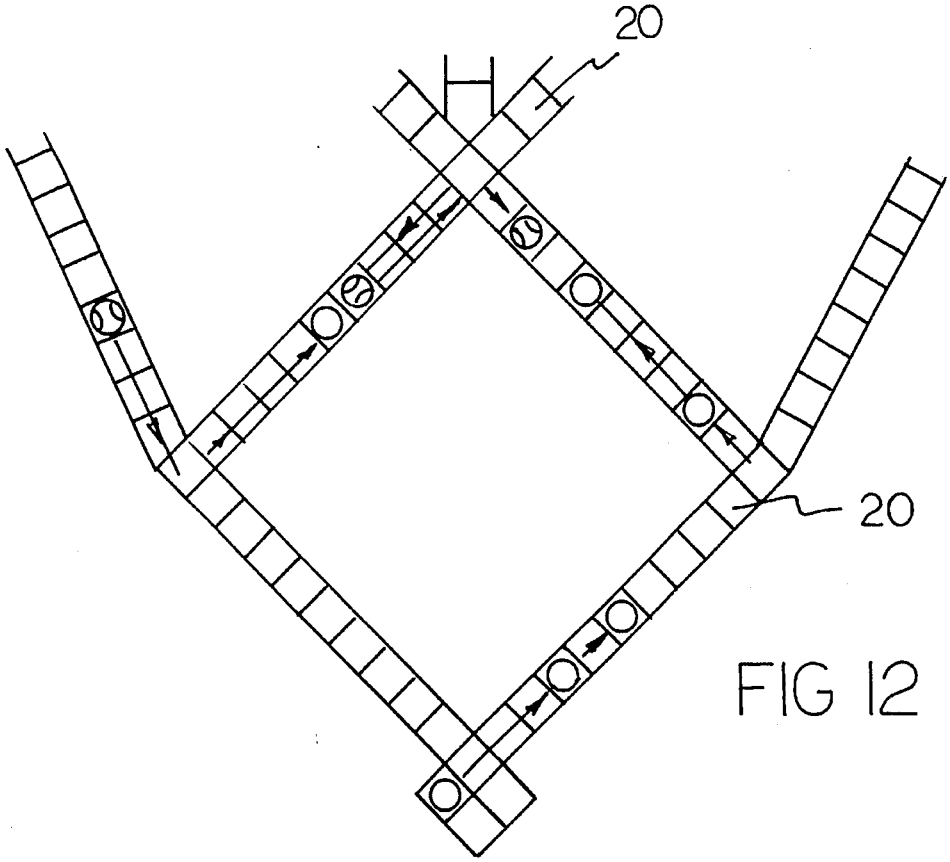
FIG 12

BASEBALL BOARD GAME

BACKGROUND OF THE INVENTION

1. Field of the Invention

The present invention relates to a baseball board game and more particularly pertains to simulating the sport of playing baseball to aide in the learning of all aspects of the sport of baseball with a baseball board game.

2. Description of the Prior Art

The use of baseball games is known in the prior art. More specifically, baseball games heretofore devised and utilized for the purpose of playing baseball on a board game are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,183,266 to Kohler discloses a baseball board game.

U.S. Pat. No. 5,135,230 to Denman et al. discloses a baseball franchise game.

U.S. Pat. No. 5,129,651 to Tobias, Jr. discloses a baseball board game and method of play.

U.S. Pat. No. 4,179,123 to Tsukunda discloses a baseball board game.

U.S. Pat. No. 3,972,530 to Dohn discloses a board baseball game.

While these devices fulfill their respective, particular objective and requirements, the aforementioned patents do not describe a baseball board game for simulating the sport of playing baseball to aide in the learning of all aspects of the sport of baseball.

In this respect, the baseball board game according to the present invention substantially departs from the conventional concepts and designs of the prior art, and in doing so provides an apparatus primarily developed for the purpose of simulating the sport of playing baseball to aide in the learning of all aspects of the sport of baseball.

Therefore, it can be appreciated that there exists a continuing need for new and improved baseball board game which can be used for simulating the sport of playing baseball to aide in the learning of all aspects of the sport of baseball. In this regard, the present invention substantially fulfills this need.

SUMMARY OF THE INVENTION

In the view of the foregoing disadvantages inherent in the known types of baseball games now present in the prior art, the present invention provides an improved baseball board game. As such, the general purpose of the present invention, which will be described subsequently in greater detail, is to provide a new and improved baseball board game and method which has all the advantages of the prior art and none of the disadvantages.

To attain this, the present invention essentially comprises a game board defining a substantially flat, horizontally arranged playing surface. The game contains a means for defining a representation of an infield, an outfield, a foul territory, and a batter's box upon the playing surface of the game board. A plurality of ball squares are defined on the playing surface. The ball squares each have a selected color thereon. The ball squares each have a selected first number thereon. The ball squares each have a selected second number thereon. Outermost ball squares are designated to define doubles, triples, and home runs. The game includes a ball chip. The ball chip is selectively positionable on the plurality of ball squares. The game includes a plurality of different colored cards. Each of the colored cards correspond to the selected color of the plurality of ball squares for the purpose of determining the position of the ball chip thereon. The game has a red die having a plurality of numbers thereon. The numbers of the red die correspond with the selected first number on the plurality of ball squares. The numbers determine the position of the ball chip on the plurality of ball squares. The game includes a blue die having a plurality of numbers thereon. The numbers of the blue die correspond with the selected second number on the plurality of ball squares. The numbers determine the position of the ball chip on the plurality of ball squares. The game includes a plurality of player chips. Each of the player chips selectively move along the plurality of squares within the infield of the playing surface. The player chips movements are determined by the rolling of the red die. A scoreboard is positioned on an uppermost portion of the game board. The scoreboard keeps score of players participating in the game. The game includes a plurality of numbered chips. Each of the numbered chips signify a score on the scoreboard of the players. The game includes four out cards. The four out cards signify when one of the player's has an out.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball board game which has all the advantages of the prior art baseball games and none of the disadvantages.

It is another object of the present invention to provide a new and improved baseball board game which may be easily and efficiently manufactured and marketed.

It is a further object of the present invention to provide a new and improved baseball board game which is of durable and reliable construction.

An even further object of the present invention is to provide a new and improved baseball board game which is susceptible of a low cost of manufacture with regard to both materials and labor, and which accordingly is then susceptible of low prices of sale to the consuming public, thereby making such a baseball board game economically available to the buying public.

Still yet another object of the present invention is to provide a new and improved baseball board game which provides in the apparatuses and methods of the prior art some of the advantages thereof, while simultaneously overcoming some of the disadvantages normally associated therewith.

Even still another object of the present invention is to provide a new and improved baseball board game for simulating the sport of playing baseball to aide in the learning of all aspects of the sport of baseball.

Lastly, it is an object of the present invention to provide a new and improved baseball board game which essentially utilizes a plurality of ball squares, a plurality of colored cards, and red and blue dice to simulate a real baseball game by the frequency of plays and events which occur during an actual baseball game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the baseball board game constructed in accordance with the principles of the present invention.

FIG. 2 is a perspective view of the of the playing cards of the present invention.

FIG. 3 is a perspective view of the out cards of the present invention.

FIG. 8 is a view of an example of a correct ball advancement of the present invention.

FIG. 9 is a view of an example of a correct ball advancement of the present invention.

FIG. 10 is a view of an example of a correct ball advancement of the present invention.

FIG. 11 is a view of an example of an incorrect ball advancement of the present invention.

FIG. 12 is a view of a typical play of the present invention.

The same reference numerals refer to the same parts through the various Figures.

DESCRIPTION OF THE PREFERRED EMBODIMENT

Figure 4:
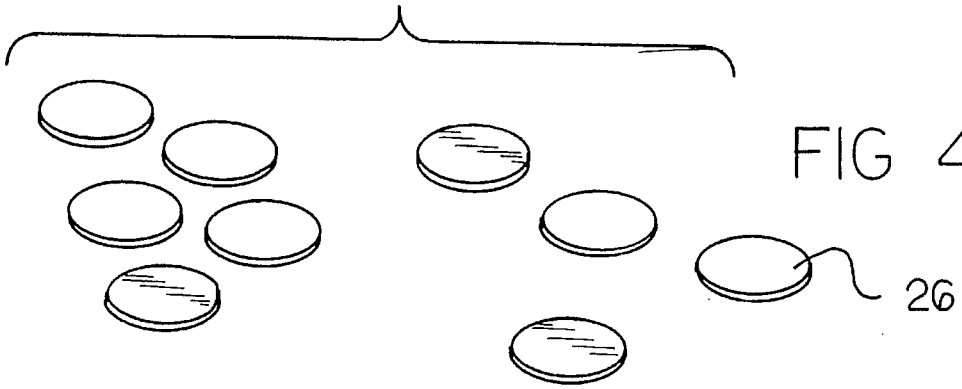
FIG. 4 is a perspective view of the batter chips of the present invention.
Figure 5:
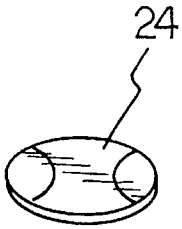
FIG. 5 is a perspective view of the ball chip of the present invention.
Figure 6:
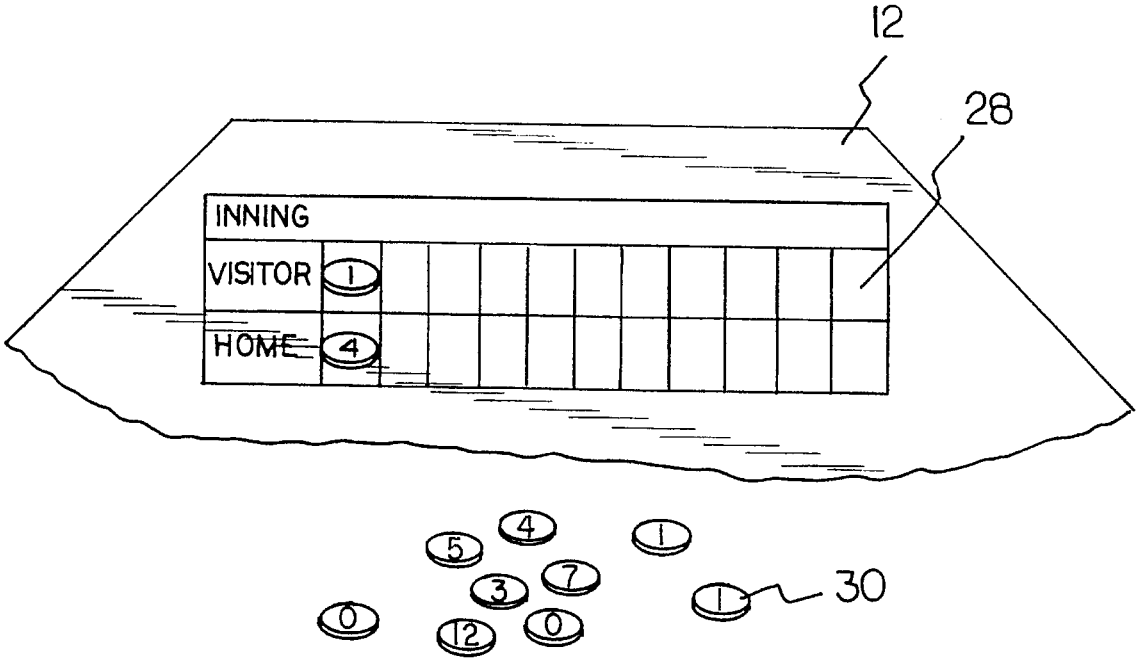
FIG. 6 is a perspective view of the scoreboard and scoring chips of the present invention.
Figure 7:
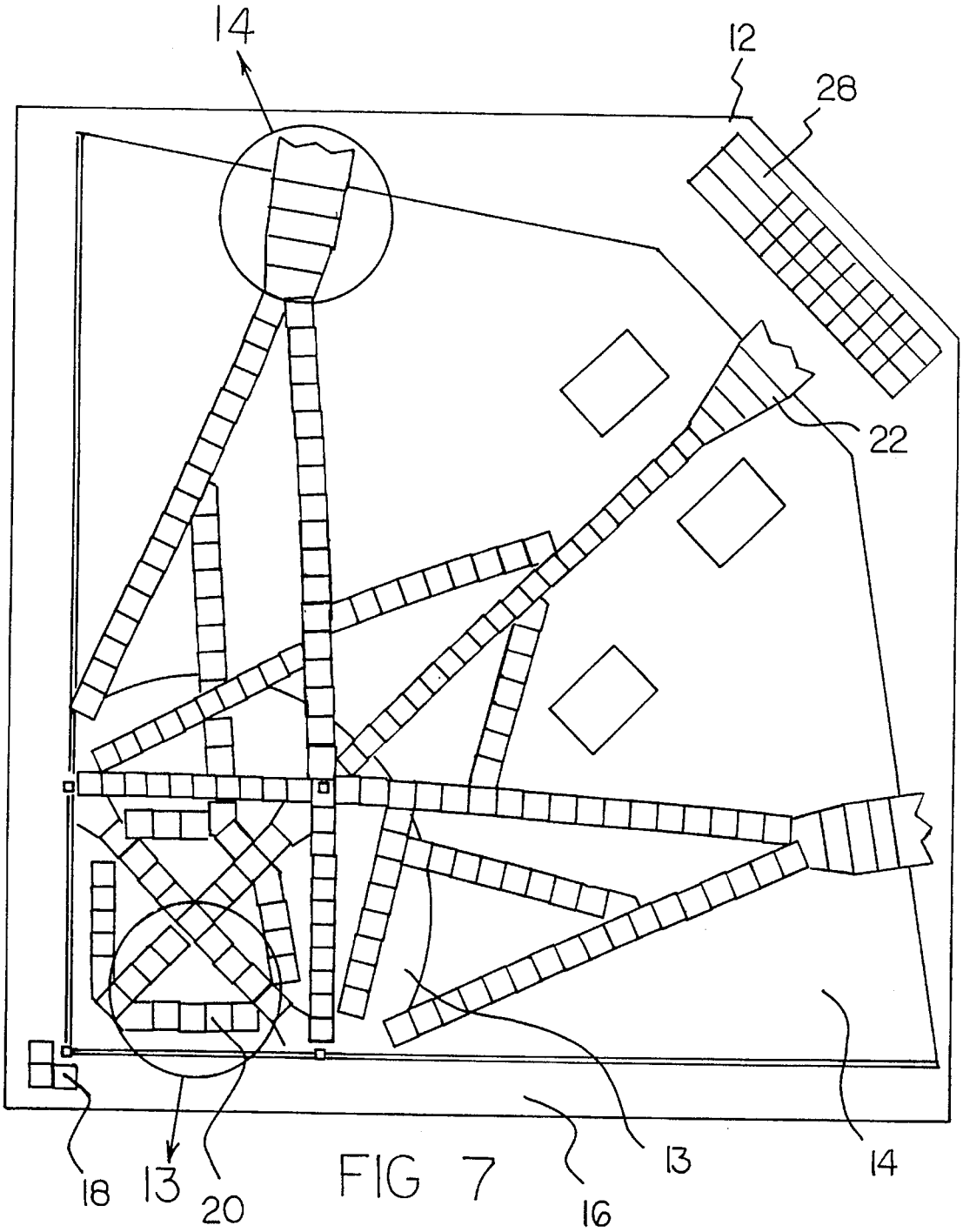
FIG. 7 is a plan view of the game board and pathways of the present invention.
Figure 13:
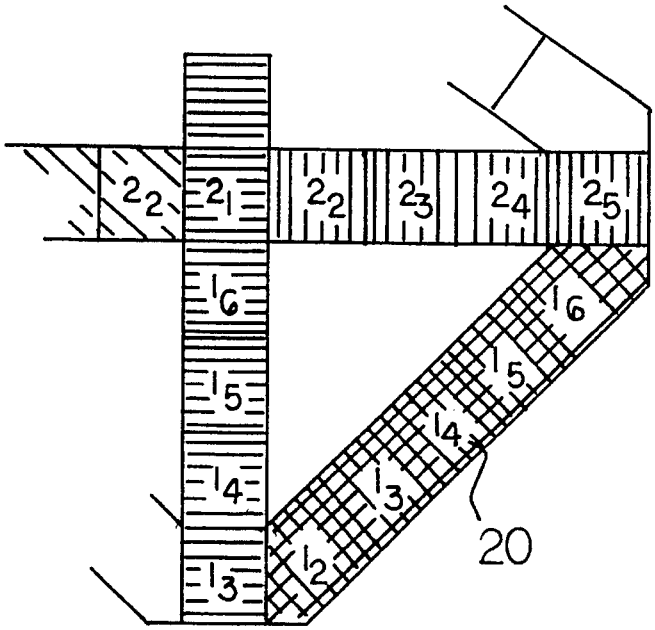
FIG. 13 is a view of the board game illustrating the ball squares having a selected color and a first and second number thereon.
Figure 14:
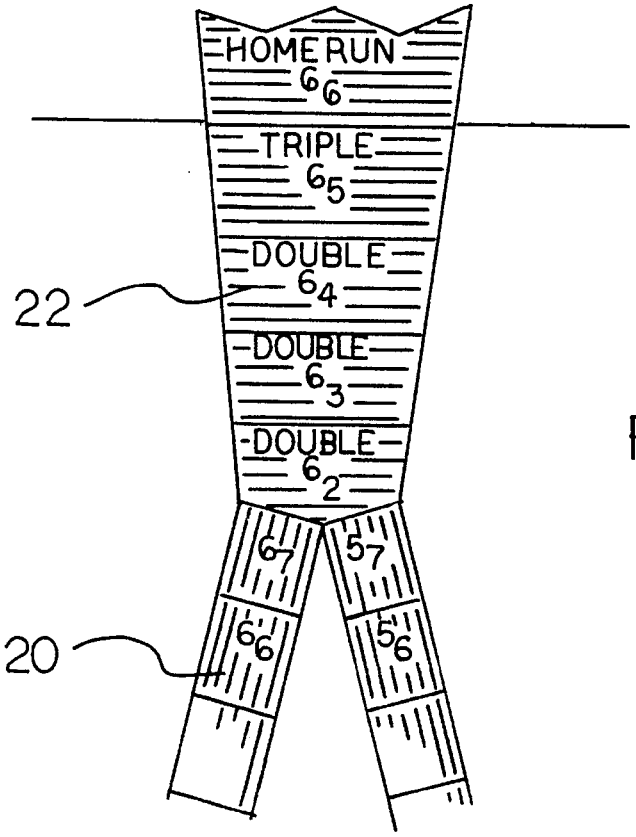
FIG. 14 is a view of the outermost ball squares defining double, triple, and home runs thereon.

With reference now to the drawings, and in particular, to FIG. 1 thereof, the preferred embodiment of the new and improved baseball board game embodying the principles and concepts of the present invention and generally designated by the reference number 10 will be described.

Specifically, it will be noted in the various Figures that the game relates to a new and improved baseball board game for simulating the sport of playing baseball to aide in the learning of all aspects of the sport of baseball. In its broadest context, the device consists of a game board, a plurality of ball squares, a ball chip, a plurality of different colored cards, a red die, a blue die, a plurality of player chips, a scoreboard, a plurality of numbered chips, and four out cards.

The game 10 contains a game board 12 defining a substantially flat, horizontally arranged playing surface. The game 10 contains a means for defining a representation of an infield 13, an outfield 14, a foul territory 16, and a batter's box 18 upon the playing surface of the game board 12.

A plurality of ball squares 20 are defined on the playing surface. The ball squares 20 each have a selected color thereon. The ball squares 20 each have a selected first number thereon. The ball squares 20 each have a selected second number thereon. Outermost ball squares 22 are designated to define doubles, triples, and home runs.

The game 10 includes a ball chip 24. The ball chip 24 is selectively positionable on the plurality of ball squares 20.

The game 10 includes a plurality of different colored cards 26. Each of the colored cards 26 correspond to the selected color of the plurality of ball squares 20 for the purpose of determining the position of the ball chip 24 thereon.

The game 10 has a red die having a plurality of numbers thereon. The numbers of the red die 28 correspond with the selected first number on the plurality of ball squares 20. The numbers determine the position of the ball chip 24 on the plurality of ball squares 20.

The game 10 includes a blue die having a plurality of numbers thereon. The numbers of the blue die correspond with the selected second number on the plurality of ball squares 20. The numbers determine the position of the ball chip 24 on the plurality of ball squares 20.

The game 10 includes a plurality of player chips 26. Each of the player chips 26 selectively move along the plurality of squares 20 within the infield 12 of the playing surface. The player chips 26 movements are determined by the rolling of the red die.

A scoreboard 28 is positioned on an uppermost portion of the game board 12. The scoreboard 28 keeps score of players participating in the game 10.

The game 10 includes a plurality of numbered chips 30. Each of the numbered chips 30 signify a score on the scoreboard 28 of the players.

The game 10 includes four out cards 32. The four out cards 32 signify when one of the player's has an out.

The present invention is a game that simulates 10 the sport of playing baseball that includes a baseball diamond, two opposing teams, and a variety of paths the ball can take.

This game 10 consists of one game board 12, twenty-seven colored cards 26, four cards for indication of outs 32, nine chips, a round chip, numbered scoring chips 30, a red die, and a blue die. The board 12 is rectangular and contains three white boxes, a score box, and a baseball field with square spaces on it. A baseline pattern is followed by the spaces along with outfield routes. Each white box holds cards for different actions: ball, route, and outs.

The objective of this baseball game, like any other, is to reach home plate and score a point for the team. A winner is determined from the greatest number of points received after a predetermined number of innings. Each player must move from home to first base, second base, third base, and back to home. The way the dice fall determines the progress and problems, such as outs, triple plays, etc. The scores of the players are kept on the scoreboard with numbered chips.

This game helps children and adults learn all aspects of the sport of baseball and brings them to life. The players must roll dice, think quickly, and use numerical skills and strategies. It provides entertainment for groups of all ages and especially those who cannot engage in the physical game of baseball.

A detailed copy of the rules and aspects of the game can be made available. It is assumed that the one reading the above description is familiar with the way baseball is played and the rules of the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A baseball board game for simulating the sport of playing baseball to aide in the learning of all aspects of the sport of baseball comprising, in combination:

a game board defining a substantially flat, horizontally arranged playing surface;

a means for defining a representation of an infield, an outfield, a foul territory, and a batter's box upon the playing surface of the game board;

a plurality of ball squares defined on the playing surface, the ball squares each having a selected color thereon, the ball squares each having a selected first number thereon, the ball squares each having a selected second number thereon, outermost ball squares designated to define doubles, triples, and home runs;

a ball chip, the ball chip selectively positionable on the plurality of ball squares;

a plurality of different colored cards, each of the colored cards corresponding to the selected color of the plurality of ball squares for the purpose of determining the position of the ball chip thereon;

a red die having a plurality of numbers thereon, the numbers of the red die corresponding with the selected first number on the plurality of ball squares, the numbers determining the position of the ball chip on the plurality of ball squares;

a blue die having a plurality of numbers thereon, the numbers of the blue die corresponding with the selected second number on the plurality of ball squares, the numbers determining the position of the ball chip on the plurality of ball squares;

a plurality of player chips, each of the player chips selectively moving along the plurality of squares within the infield of the playing surface, the player chips movements determined by the rolling of the red die;

a scoreboard positioned on an uppermost portion of the game board, the scoreboard keeping score of players participating in the game;

a plurality of numbered chips, each of the numbered chips signifying a score on the scoreboard of the players;

four out cards, the four out cards signifying when one of the player's has an out.

2. The board game according to claim 1 and further including three white box card holders positioned on the game board to receive the player chips, out cards, and the different colored cards therein.

3. The board game according to claim 2 and further wherein the plurality of colored cards and the red die and the blue die in cooperation define fly-outs, strike outs, foul balls, base on balls, stealing bases, wild pitches, and double or triple plays.

4. A baseball board game for simulating the sport of playing baseball to aide in the learning of all aspects of the sport of baseball comprising, in combination:

a game board defining a substantially flat, horizontally arranged playing surface;

a plurality of ball squares defined on the playing surface, the ball squares each having a selected color thereon, the ball squares each having a selected first number thereon, the ball squares each having a selected second number thereon, outermost ball squares designated to define doubles, triples, and home runs;

a ball chip, the ball chip selectively positionable on the plurality of ball squares;

a plurality of different colored cards, each of the colored cards corresponding to the selected color of the plurality of ball squares for the purpose of determining the position of the ball chip thereon;

a red die having a plurality of numbers thereon, the numbers of the red die corresponding with the selected first number on the plurality of ball squares, the numbers determining the position of the ball chip on the plurality of ball squares;

a blue die having a plurality of numbers thereon, the numbers of the blue die corresponding with the selected second number on the plurality of ball squares, the numbers determining the position of the ball chip on the plurality of ball squares;

a plurality of player chips, each of the player chips selectively moving along the plurality of squares within the infield of the playing surface, the player chips movements determined by the rolling of the red die.

* * * * *